United States Patent [19]

Schaub et al.

[11] Patent Number: 4,844,474

[45] Date of Patent: Jul. 4, 1989

[54] EXPLODING TOY APPARATUS

[75] Inventors: Randolph S. Schaub, Fountain Valley; Terence A. Choy, Hermosa Beach, both of Calif.

[73] Assignee: Mattel, Inc., Hawthorne, Calif.

[21] Appl. No.: 145,352

[22] Filed: Jan. 19, 1988

[51] Int. Cl.[4] ..... F41J 5/02

[52] U.S. Cl. ..... 273/310; 273/380; 446/175

[58] Field of Search ..... 273/310, 380, 311, 312, 273/1 G, 1 GE, 1 GF; 446/4, 6, 175, 473

[56] References Cited

U.S. PATENT DOCUMENTS

| | | | |
|---|---|---|---|
| 276,539 | 4/1983 | Reed | 446/4 |
| 1,145,420 | 7/1915 | Huth | 446/4 |
| 1,859,100 | 2/1931 | Lewis | 446/4 |
| 2,052,841 | 10/1984 | O'Donnell | 446/4 |
| 3,037,772 | 6/1962 | Bonanino | 446/6 |
| 3,240,924 | 3/1965 | Darby | 446/473 |
| 3,483,636 | 12/1969 | Knapp et al. | 273/312 |
| 3,528,193 | 9/1970 | Yamakawa | 446/86 |
| 4,054,290 | 10/1977 | Villa | 273/310 |
| 4,090,714 | 5/1978 | Izushi | 273/310 |
| 4,212,412 | 7/1980 | Ikeda | 273/310 |
| 4,232,865 | 11/1980 | Chen et al. | 273/311 |
| 4,266,777 | 5/1981 | Ikeda | 273/310 |
| 4,502,691 | 3/1985 | Ratliff et al. | 273/380 |

*Primary Examiner*—Richard C. Pinkham
*Assistant Examiner*—Benjamin Layno
*Attorney, Agent, or Firm*—Ronald M. Goldman; Melvin A. Klein; Daniel F. Sullivan

[57] ABSTRACT

A toy apparatus having a plurality of exploding members exploded and ejected from a housing in seriatum by radiant energy hitting the housing at a predetermined location. The exploding members are held to the housing by latches positioned in the path of a cam member driven intermittently by a drive mechanism in response to radiation aimed at a detector on the housing. The exploding members are exploded from the housing in seriatum as radiation is repeatedly aimed at the detector.

4 Claims, 5 Drawing Sheets

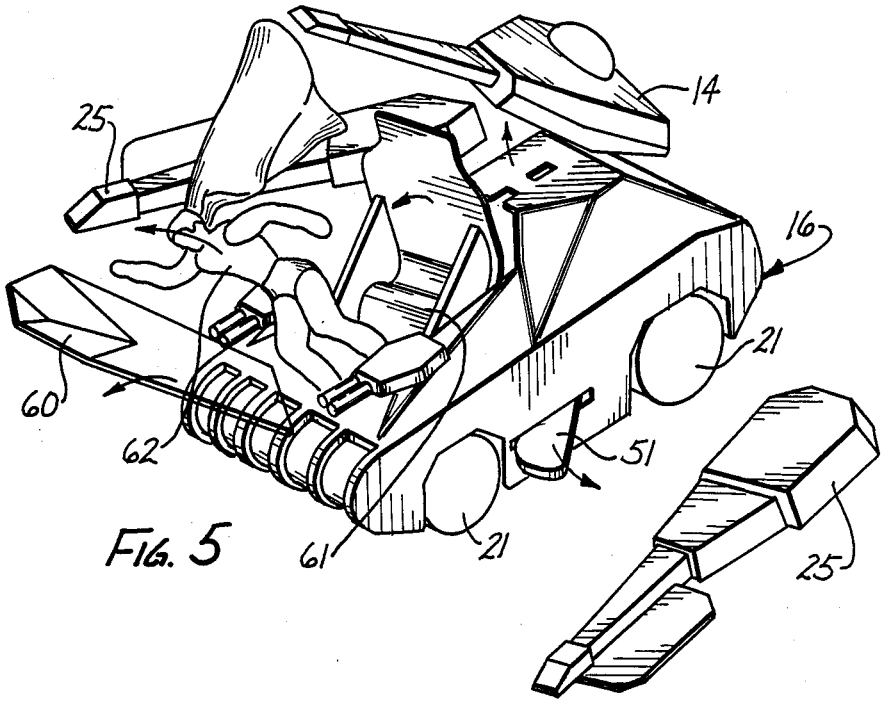
FIG. 5
FIG. 6
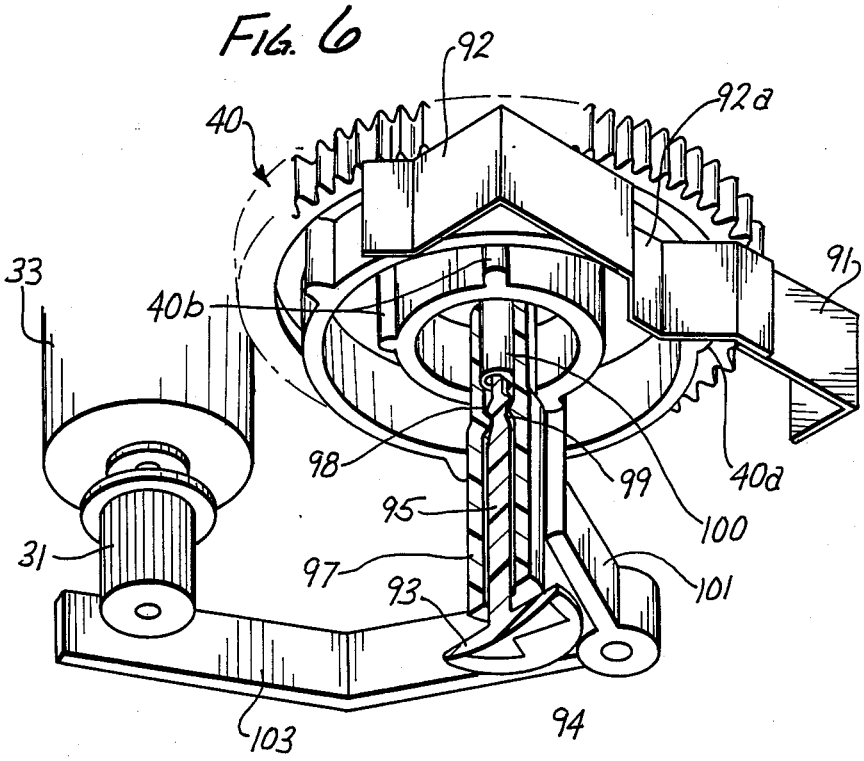

EXPLODING TOY APPARATUS

BACKGROUND OF THE INVENTION

1. Field of the Invention

This invention relates to a toy apparatus having a plurality of members exploded from a housing in seriatum upon hitting the toy apparatus as a target in a game mode of operation.

2. Description of the Prior Art U.S. Pat. No. 276,539 shows a knockdown or building block toy. U.S. Pat. No. 1,145,420 shows a toy war boat which disengages simulating blowing up of the boat. U.S. Pat. No. 1,859,100 shows an explosive toy with separable parts to simulate internal explosion. U.S. Pat. No. 2,052,841 shows a toy block structure with spring to throw the blocks apart. U.S. Pat. No. 3,037,772 shows an exploding toy vehicle. U.S. Pat. No. 3,240,924 shows a target gun for target practice. U.S. Pat. No. 3,483,636 shows a hit indicator system with barrel-bore mounted photoscope.

U.S. Pat. No. 3,528,193 shows a dismountable moving toy.

U.S. Pat. No. 4,054,290 shows a light gun having selectable modulated infrared output.

U.S. Pat. No. 4,090,714 shows a rope controlled photo target.

U.S. Pat. No. 4,212,412 shows a turntable article holding with ejector.

U.S. Pat. No. 4,232,865 shows a radiation sensing mobile target game

U.S. Pat. No. 4,266,777 shows a target apparatus for ejecting articles.

BRIEF DESCRIPTION OF THE INVENTION

A primary aspect of the invention is that the toy apparatus has a housing having a plurality spring-biased exploding of members that are secured to the housing by latches. Upon actuation of a drive gear mechanism in response to electrical signals, a cam gear is rotated in a path to disengage the latches thereby enabling the members to be exploded from the housing in seriatum.

The drive gear mechanism is intermittently actuated so that only one exploding member at a time is released from the housing to provide the exploding action in seriatum. Radiation is aimed at a detector connected to a battery operated circuit positioned on the toy apparatus during the playing action to provide the electrical signals to actuate the drive gear mechanism. A switch closes and opens intermittently to cause the drive gear mechanism to start and stop. Upon scoring a series of hits the toy apparatus explodes a series of members upon each hit. Thus, a more realistic play action is provided for the child.

DESCRIPTION OF THE DRAWINGS

The invention is more fully described with reference to the accompanying drawings, in which:

FIG. 5 is a view of the toy apparatus showing the various members exploded from the toy apparatus; and FIG. 6 is a perspective view of the indicator assembly with parts in section to illustrate certain details thereof.

DESCRIPTION OF THE PREFERRED EMBODIMENT

Figure 1:
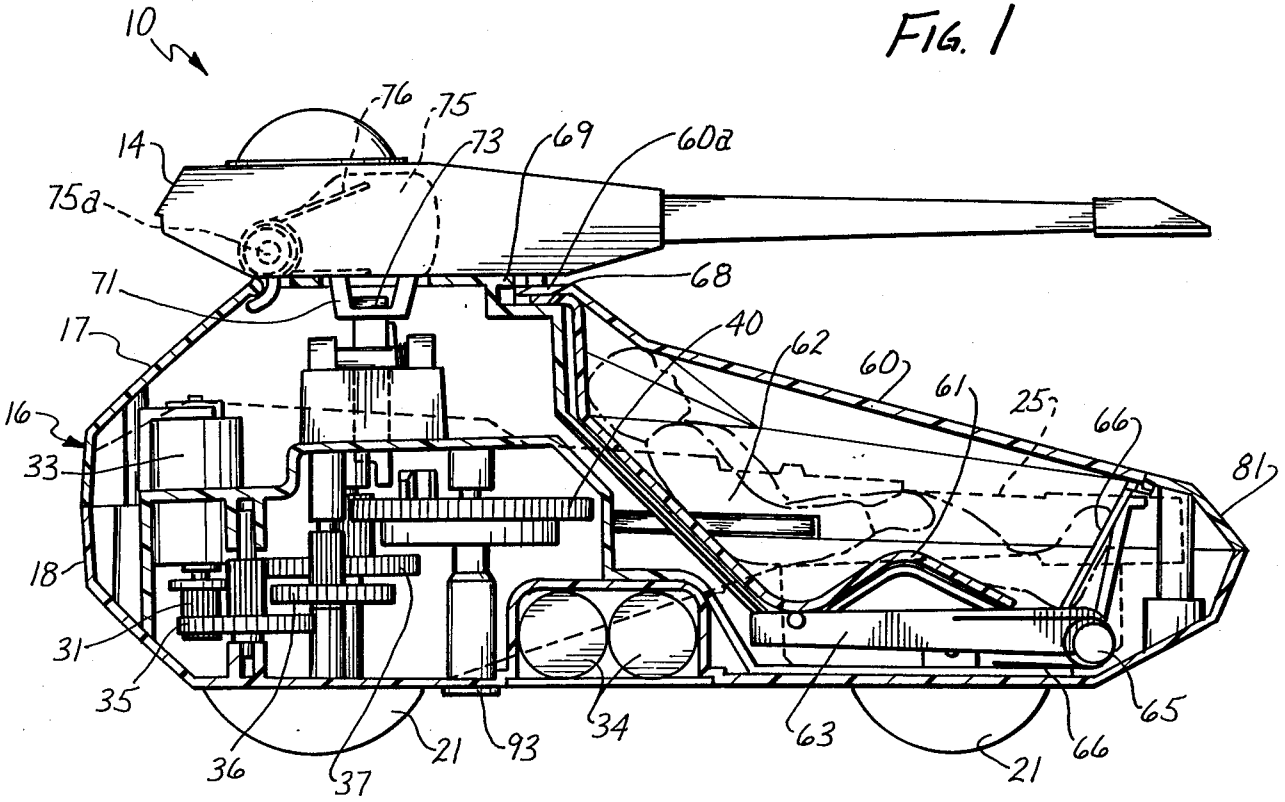
FIG. 1 is a side elevational view of the toy apparatus with certain parts in section according to the present invention.
Figure 2:
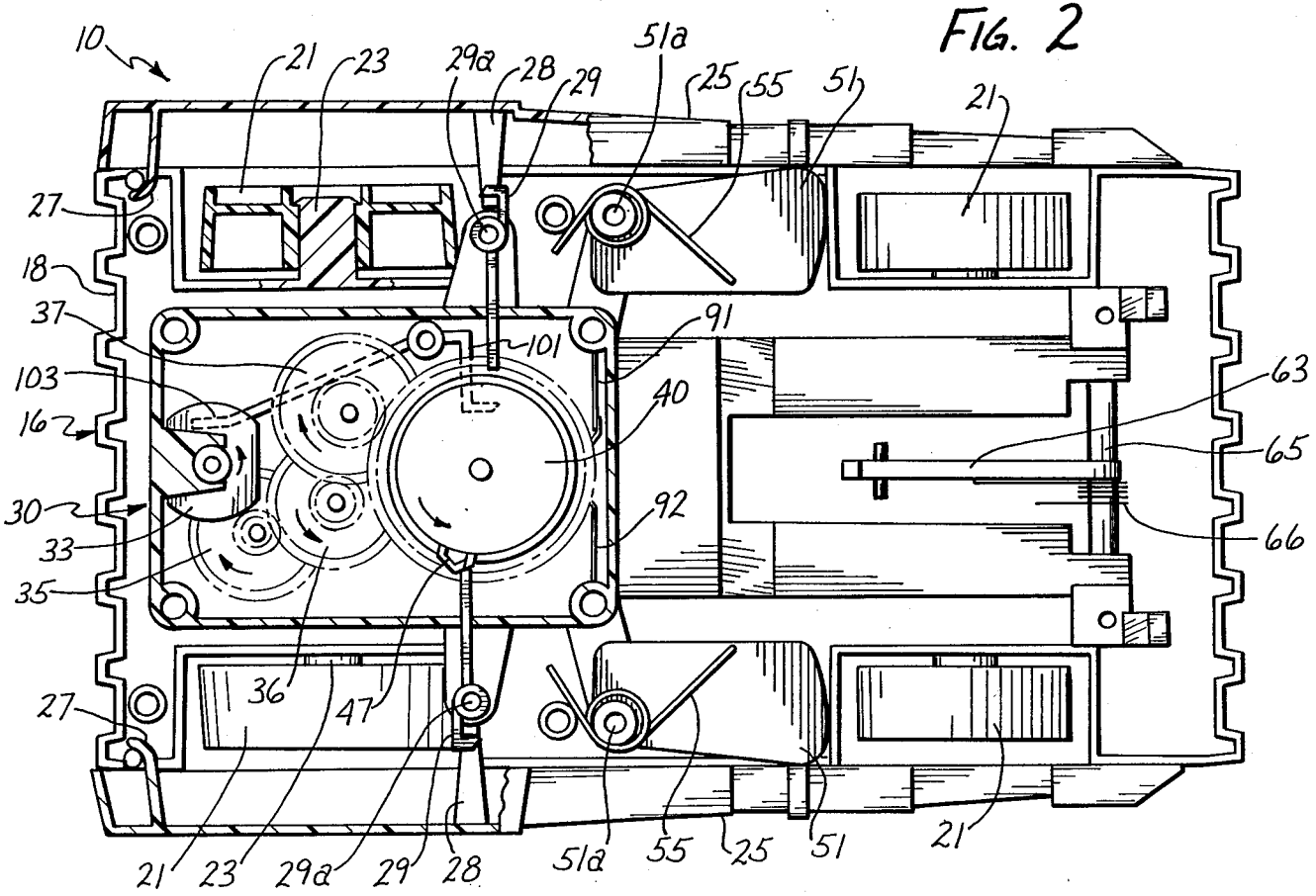
FIGS. 2 and 2A are plan views of the toy apparatus shown in FIG. 1 with certain parts in section to illustrate certain details thereof.
Figure 2A:
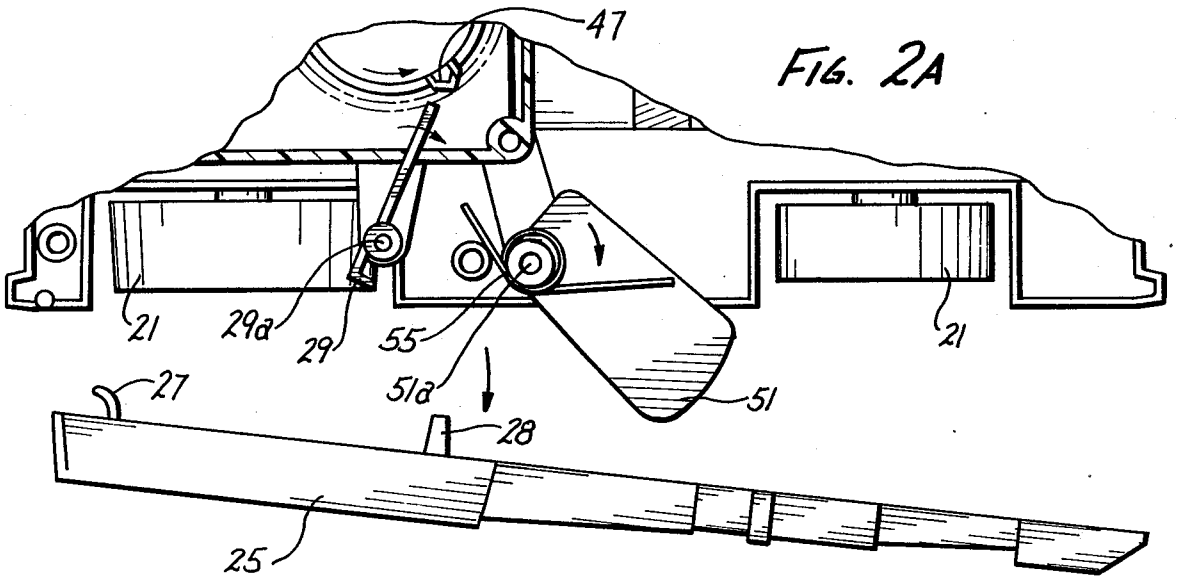

Referring now to FIGS. 1 and 2, there is shown the toy apparatus according to the invention generally designated 10 which is shown as a tank vehicle. It will be appreciated that the toy apparatus may take any form that is suitable for play action. Toy apparatus 10 includes a detachable turret module 14 and a housing 16. To facilitate construction, housing 16 includes an upper section 17 and a lower section 18 that are snapped together for a friction fit. Housing 16 is supported by wheel members 21 that are received onto extension members 23 from the housing in a press fit.

Positioned on the sides of housing 16 are a pair of armor plate members 25. Each of the armor plate members 25 is secured to housing 16 by a hook member 27 and by a hook member 28 which is engaged by a latch member 29. Each of the armor plate members 25 and turret module 14 is capable of being exploded away from housing 16 in seriatum as will be more fully understood hereinafter.

For exploding away the armor plate members and turret module, there is provided a motor driven gear mechanism 30. Gear mechanism 30 includes a gear 31 that is driven by a DC motor 33 connected to batteries 34 as a power supply. Gear 31 meshes with a series of reduction gears 35, 36, and 37. Gear 37 drives a cam gear member 40.

Figure 4:
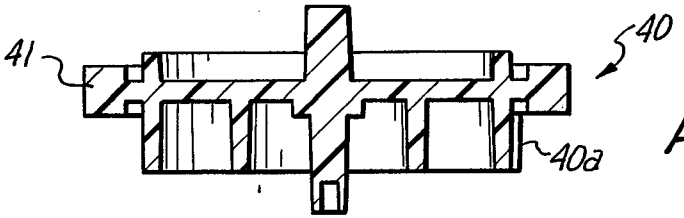
FIG. 4 is an elevational view of the cam gear member.
Figure 3:
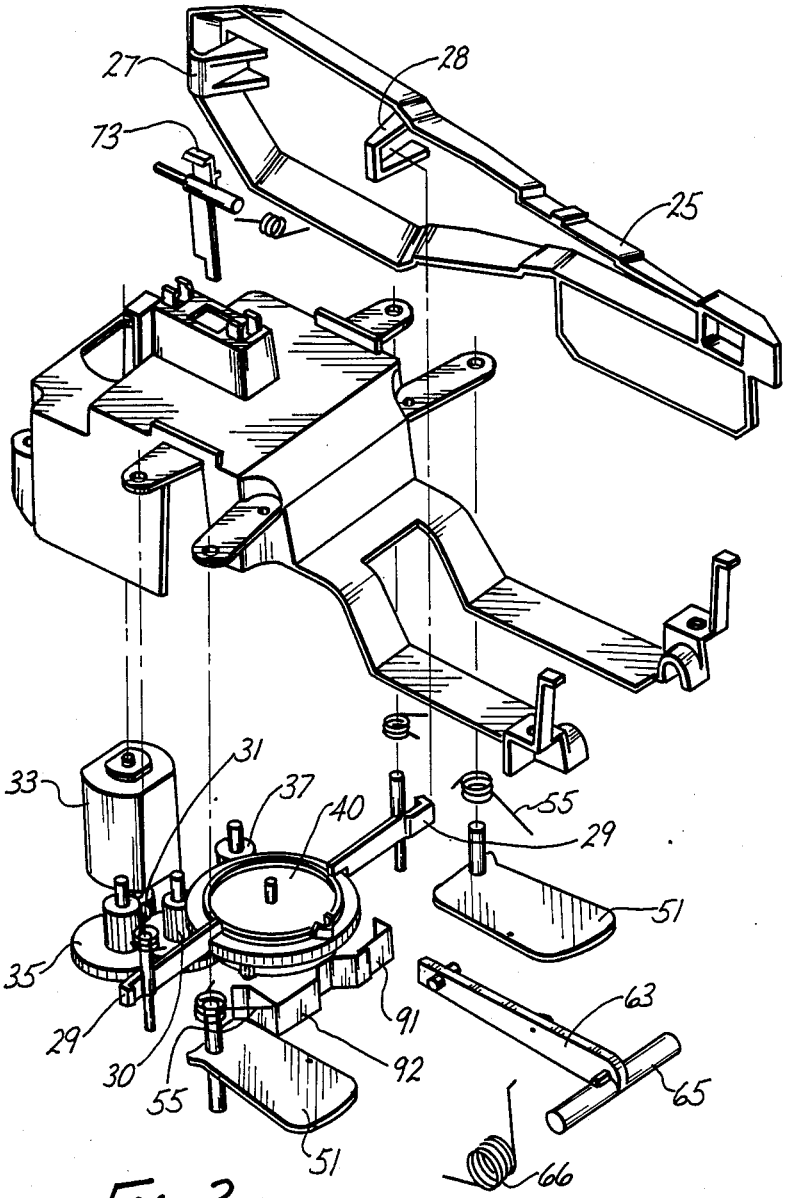
FIG. 3 is a partial exploded view illustrating sequential operation of the toy apparatus.

Cam gear member 40 (FIG. 4) has a gear section 41 and an upper cam lobe 43 for engaging latch members 29 to cause actuation of the exploding armor plate members 25 and turret module 14 of the apparatus. Also, cam gear member 40 has a lower cam surface 45 having a plurality of cam lobes 47 and a lower cam surface 48 having a plurality of cam lobes 49 for a purpose to be described. Latch members 29 are pivotally mounted on pin portions **29*a* journaled in the housing 16. The latch members 29 normally engage armor plate members 25. Each of a pair of panel ejector members 51 is pivotally mounted on a pin portion 51*a* journaled in the housing 16 for urging the armor plate members 25 outwardly away from the housing. An ejector spring member 55 is associated with each of the panel ejector members 51 to provide biasing action to explode away the armor plate members 25 from housing 16**.

It will now be appreciated that the armor plate members 25 are retained by latch members 29 until such time as the cam gear member 40 is rotated sufficiently such that cam lobe 43 is moved to disengage a latch member 29 from its associated armor plate member by pivoting the appropriate latch member in sequence. By this structure, each of the spring actuated panel members 51 ejects the associated armor plate member from the housing in seriatum.

To explode away the turret module 14 there is continued rotational movement of the cam gear member 40 to cause disengagement of the turret module from the housing as will become more apparent. Housing 16 is hollow to accommodate a compartment for transparent canopy 60 as a cover for a seat member 61 that is used to support a toy FIG. 62 positioned in the compartment.

Seat member 61 is positioned to abut a seat ejector plate member 63 which is pivotally mounted to move from a horizontal position to a position at about 45 degrees from the horizontal. Pivoting of plate member 63 is effected by rotation of pin portions 65 due to action by a spring member 66. Spring member 66 is wound along a pin portion 65 to provide sufficient pivotable force to the ejector plate member 63 causing the seat member 61 and toy FIG. 62 to be expelled from the compartment.

Seat member 61 is loaded into the compartment against the action of the spring member 66 causing the plate member 63 to assume the horizontal position. The seat member 61 is temporarily retained by engagement of a horizontal extension 68 of seat member 61 by a protrusion 69 extending from housing 16. A canopy 60 is positioned overlying the seat member and toy figure. It will be noted one end of canopy 60 has an extension 60*a* retained by the turret module 14 upon assembling the turret module to the housing. It will be further noted that as the turret module 14 is assembled to the housing 16 such that seat member 61 is moved from a temporarily retained position to an unlocked position out of engagement with protrusion 69.

Turret module 14 is attached to the housing 16 by engagement of hook members 70 with housing 16 and by engagement of a yoke 71 extending from the turret module with a latch member which is similar to latch member 29. Extending from turret module 14 is a pair of turret ejector members 75 similar to ejector members 51. Members 75 are biased downwardly toward housing 16 by a spring member 76 encircling pin portions 75*a* on members 75. Members 75 are rotated and received in the turret module 14 when assembled to housing 16 (FIG. 1).

Upon continued rotation of the cam gear member 40, the upper cam surface 43 contacts the lower end of latch member 73 causing the latch member 73 to become disengaged from the yoke 71 of the turret module 14. As a result, the turret module is exploded away from the housing due to the action of spring actuated turret ejector members 75. At the same time, canopy 60, seat member 61 and toy FIG. 62 are exploded away from the housing in a forward direction.

The cam gear member 40 is operated in intermittent fashion to release first an armor plate member 25 at the side of the vehicle and then a second armor plate member 25 at the opposite side of the vehicle and then finally, the turret module together with canopy, seat member and toy figure in seriatum. At the forward part of the vehicle is a radiation detector or a photosensor 81 for receiving suitable radiation, such as infrared or white light through a lens 82. Radiation detector 81 is mounted on a circuit board 83. Upon detection of radiation by detector 81, electrical signals are supplied to energize motor 33 to drive cam gear member 40 intermittently as will be understood more fully hereinafter.

The control for energizing motor 33 includes a cam contact member 91 and a switch contact member 92 positioned in overlying relationship (FIG. 6). Switch contact member 92 causes the circuit energizing motor 33 to open and close sequentially upon rotation of the cam gear member 40 upon contact of cam lobes 47 with flat portion 92*a* of switch contact member 92. The motor will become energized upon radiation being received by the detector 81 and the motor will continue to be energized until the cam gear member 40 is rotated to a position where a cam lobe 47 contacts flat portion 92*a* to separate switch contact member 92 from cam contact member 91 to open the circuit. When the circuit is opened, the motor becomes de-energized and the gear mechanism stops.

During the time that the motor has been energized, one of the armor plate members will have been exploded from the vehicle. Subsequently, when radiation is received by the detector 81, the motor 33 will again become energized, causing the gear mechanism to drive the cam gear member and cause a second armor plate member to be exploded from the vehicle. The same action will continue until the turret module 14, canopy 60, seat member 61, and toy FIG. 62 are exploded from the vehicle by the cam gear member engaging latch member 73 to release the turret module, canopy, seat member, and toy figure from the vehicle.

To enable the operator of the toy apparatus to know exactly which module will be exploded next in sequence, there is provided an indicator member 93 (FIG. 6). Indicator member 93 has marking indicia 94 in the form of an arrow to show which module will be exploded next in sequence. Member 93 has an elongated rod 95 which is received into a tubular extension 97 extending from housing 16. Elongated rod 95 has an annular portion 98 which is received into shoulder 99 formed in tubular extension 97 by a snap action. The end of rod 95 is received into a tubular member 100 which is integral with cam gear member 40 and driven by the gear mechanism previously described.

To prevent drift by the gear mechanism 30 cam gear member 40 has an additional lower cam surface 48 having a plurality of cam lobes 49 (FIG. 6). Cam lobes 49 engage a cam arm 101 which is pivoted with respect to housing 16 causing an extension 103 of the cam arm 101 to contact gear 31 driven by motor 33. By this structure, gear mechanism 30 is stopped to prevent unwanted drifting movement by momentum.

It will now be appreciated that by the above-described invention a novel toy apparatus is provided which enables exploding different members in seriatum from the toy apparatus to enhance the play action and enjoyment by a child. By the toy apparatus exploding members in series, a more realistic and entertaining play action is provided which enhances the value of the apparatus.

What is claimed is:

1. Toy apparatus having a plurality of exploding members exploded in seriatum comprising a housing, a plurality of exploding members secured to said housing by latching means associated with each one of said members, each of said exploding members being held by said latching means against the action of spring biasing means, cam means mounted on the housing for movement in a predetermined path for releasing each of said latching means positioned along the path, said cam means including a first cam profile portion to actuate said latching means and a second cam profile to actuate drive means, drive means supported by the housing for driving said cam means intermittently in response to electrical signals, and control means including radiation detection means for generating electrical signals to initiate actuation of said drive means to cause the drive means to start and stop after a predetermined interval whereby said members are exploded from said housing in seriatum by repeatedly directing radiation towards said detection means.

2. Apparatus according to claim 1 wherein said cam means includes a third cam profile to actuate an arresting member to engage said drive means to prevent drifting movement thereof.

3. Toy apparatus having a plurality of exploding members exploded in seriatum comprising a housing, a plurality of exploding members secured to said housing by latching means associated with each one of said members, each of said exploding members being held by said latching means against the action of spring biasing means, cam means mounted on the housing for movement in a predetermined path for releasing each of said latching means positioned along the path, drive means supported by the housing for driving said cam means intermittently in response to electrical signals, control means including radiation detection means for generating electrical signals to initiate actuation of said drive means to cause the drive means to start and stop after a predetermined interval, said control means including a cam contact member and a switch contact member for actuating said drive means and to intermittently contact each other upon rotation of said cam means whereby said exploding members are exploded from said housing in seriatum by repeatedly directing radiation towards said detection means.

4. Apparatus according to claim 3 including an indicator member to show the operator which exploding member is to be exploded next in sequence.

* * * * *